United States Patent [19]

Eisinger

[11] Patent Number: 4,981,169

[45] Date of Patent: Jan. 1, 1991

[54] FLEXIBLE ACOUSTIC BAFFLE FOR STAGGERED TUBE BANKS

[75] Inventor: Frantisek L. Eisinger, Demarest, N.J.

[73] Assignee: Foster Wheeler Energy Corporation, Clinton, N.J.

[21] Appl. No.: 465,828

[22] Filed: Jan. 12, 1990

[51] Int. Cl.[5] ..... F28F 7/00

[52] U.S. Cl. ..... 165/69; 165/162

[58] Field of Search ..... 165/69, 162; 122/367 C

[56] References Cited

U.S. PATENT DOCUMENTS 2,927,781 3/1960 Fohrhaltz et al. ..... 165/69

3,643,735 2/1972 Huggins ..... 165/69

FOREIGN PATENT DOCUMENTS 219263 6/1942 Switzerland ..... 165/162

*Primary Examiner*—John Rivell

*Assistant Examiner*—L. R. Leo

*Attorney, Agent, or Firm*—Marvin A. Naigur

[57] ABSTRACT

A corrugated-shaped acoustic baffle unit for insertion into a tube bundle of a tubular-type heat exchanger having parallel staggered tubes to prevent flow-induced vibrations in the heat exchanger. The baffle unit is formed of at least two helical-shaped spacer members each rotatably attached to a flexible connecting barrier member, such as a fabric or metal mesh material or formed by multiple adjacent bars or tubes each attached to the rotatable spacer members. The flexible corrugated-shaped baffle unit can be inserted between adjacent parallel tubes of a heat exchanger by rotating simultaneously the helical-shaped spacer members. After insertion of the baffle unit, the ends of the helical-shaped spacer members are connected together so as to prevent their further rotation and thereby secure the baffle unit firmly in place between adjacent tubes of the heat exchanger.

15 Claims, 4 Drawing Sheets

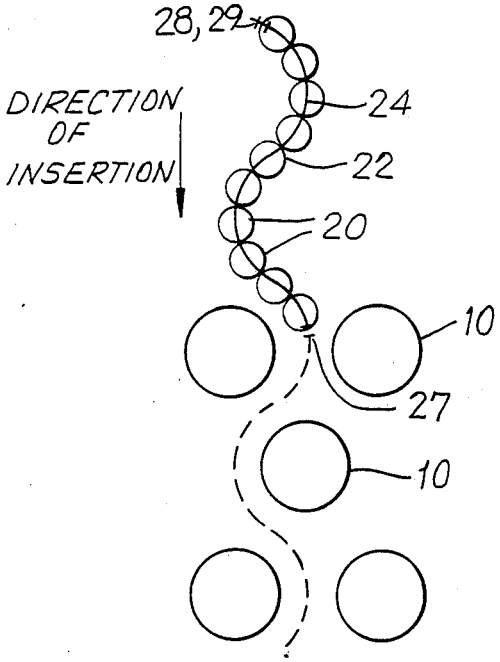
FIG. 8
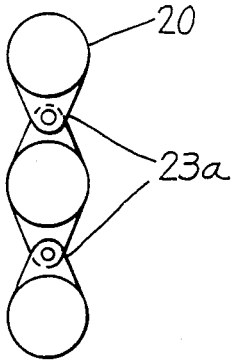
FIG. 7
FIG. 9
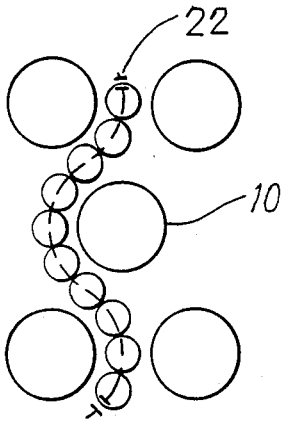

FLEXIBLE ACOUSTIC BAFFLE FOR STAGGERED TUBE BANKS

BACKGROUND OF INVENTION

This invention pertains to acoustic baffles provided between adjacent rows of tubes in tubular type heat exchangers. It pertains particularly to flexible corrugated-shaped baffles located between adjacent staggered rows of tubes in a tube bank to prevent flow induced acoustic vibrations in a tubular heat exchanger.

Flow channels of heat exchangers or steam generators containing tube arrays can be subject to acoustical resonance vibrations excited by flow of air, gas, or steam transversely across the tubes. Such resonance occurs when the frequency of a flow periodicity inside the tube bank coincides with an acoustical (standing wave) mode of the flow channel. The acoustical modes primarily excited are those which are related to the dimension perpendicular to both the fluid flow direction and the tubes axes. At resonance, an intense sound can be generated which is typically sufficient to cause noise and vibration problems within the heat exchanger.

The elimination of such resonant condition and vibration may be achieved by suppression of the excited acoustic (standing wave) modes. The commonly used method of suppressing standing waves is by use of acoustic baffles. Typically, plate baffles are placed within the tube bank parallel with the flow direction. These baffles divide the flow chamber into separate flow channels, each having a higher natural acoustic frequency than the natural frequency of the unbaffled chamber. The number of baffles used and their location within the width of the flow channel will depend on the acoustical mode frequencies which need to be achieved in order to prevent resonances.

In tubular heat exchangers having a staggered tube arrangement, there is ordinarily no room to place a baffle in the direction parallel with the flow. The only way a baffle could be inserted into the staggered tube bundle would be if space for a baffle was made by eliminating a number of tubes in alignment. However, such a solution represents a great complication in construction in that it affects the uniformity of the tube bundle and reduces the total heat transfer surface. Also for a retrofitting arrangement in heat exchangers for which acoustic baffles have to be inserted to eliminate noise in an operating unit, a structural modification involving tube removal would be prohibitively expensive.

The general use of baffles in tubular heat exchangers is known. For example, U.S. Pat. No. 1,711,622 to Vennum discloses a baffle arrangement used for water tube steam boilers in which a bank of vertically extending tubes have a plurality of straight baffles which extend at an angle through spaces between some of the rearward tubes, so as to protect those tubes from direct contact with the hot furnace gases. U.S.Pat. No. 2,655,346 to Corbitt et al discloses a heat exchanger having a matrix of parallel tubes carrying a first fluid, and having flat baffles arranged in various configurations to control transverse flow of a second fluid past the tubes. Such baffles are spaced apart so as to control fluid flow generally transverse to the tubes, but they do not support the tubes.

U.S. Pat. No. 3,163,208 to Cuzzone et al discloses use of transverse braces for supporting and inhibiting vibration of elongated finned tubes used in heat exchangers; but corrugated shaped baffles are not utilized. U.S. Pat. No. 3,720,259 to Fritz et al discloses a heat exchanger having spirally wound tubes which are supported by a spacer structure. The spiral tubes are separated into groups by a series of conical-shaped straight baffles which are oriented upwardly and provide flow passages generally transverse to the tube bundle. The tubes are each supported by upwardly extending curved wires each having a wave-shaped configuration.

U.S. Pat. No. 4,204,570 to Eisinger discloses helical-shaped tube spacers placed between adjacent tubes in a heat exchanger to support the tubes, but the spacers do not provide any useful baffling function for fluids passing transversely through the heat exchanger. U.S. Pat. No. 4,662,434 to Porowski discloses use of straight vibration dampening spacer tubes which extend transversely between adjacent tubes in a heat exchanger to laterally support the tubes, but the spacer tubes provide no significant acoustic baffling function for fluids flowing external to the heat exchanger tubes.

U.S. Pat. No. 4,796,695 to Cannon discloses a tubular heat exchanger having parallel tubes supported by corrugated slats positioned in empty lanes to separate adjacent rows of tubes. The corrugations extend along the length of the slat to support the tube and generate turbulence in transverse flow of gas, and are made of resilient material such as spring steel so as to press against the adjacent rows of tubes.

Although the prior art has disclosed various types of baffles for use in tubular heat exchangers, it has apparently not provided flexible acoustic baffles which are corrugated in shape and which can be inserted into staggered tube banks of heat exchangers to eliminate resonant flow conditions and acoustic vibrations in the heat exchangers.

SUMMARY OF INVENTION

This invention provides an acoustic baffle unit adapted for being inserted between adjacent staggered rows of tubes in tubular heat exchangers, so as to press against the tubes and prevent flow-induced acoustic vibrations within the tube bank. The baffle unit includes at least two elongated helical-shaped spacer members, which are each rotatably attached to a flexible barrier member which is made corrugated-shaped by the helical-shaped spacer members. The baffle unit is adapted for being inserted transversely into a parallel tube bundle between adjacent tubes in the fluid flow direction by simultaneous rotation of the spacer members.

The helical-shaped spacer members should be made of a rigid material such as metal or reinforced plastic and have a pitch spacing consistent with the pitch of the tube bank in which the baffle unit is installed. The flexible barrier member can be made of woven material, such as cloth or metal mesh construction. Alternatively, the barrier member can be formed by multiple adjacent bars, strips or tubes each flexibly attached together and rotatably attached to each of the rotatable helical-shaped spacer members. After installation of the baffle unit in a tubular heat exchanger, the helical-shaped spacer rod members are connected together at both their leading and trailing ends, so as to prevent further rotation of the spacer members and thereby maintain the baffle unit in place between the tubes of the tube bank.

The invention also provides a tubular type heat exchanger assembly having a plurality of adjacent parallel tubes and at least one flexible acoustic baffle unit inserted between adjacent rows of tubes in the heat exchanger. The flexible acoustic baffle unit can be inserted into the tube bundle in the transverse flow direction by rotation of the helical-shaped spacer members. The invention also includes method steps required for inserting the flexible acoustic baffle unit between adjacent rows of tubes of a tubular type heat exchanger by simultaneously rotating the spacer members.

Advantages of this acoustic baffle device for tubular heat exchangers are that it permits installation of flexible acoustic baffles between adjacent tubes in existing heat exchangers, so as to prevent flow induced acoustic vibrations therein, all without the need for substantial modification or reconstruction of the heat exchanger assembly. The sinewave-shaped acoustic baffle unit is especially suited for being retrofitted into a heat exchanger tube bundle for the elimination of noisy resonant conditions in such heat exchangers.

BRIEF DESCRIPTION OF DRAWINGS

This invention will be further described with reference to the following drawings, in which:

FIG. 7 shows typical hinged connecting joints provided between adjacent barrier bars or tubes;

FIG. 8 shows a schematic view of an acoustic baffle unit in position to be inserted into a staggered tube bank;

FIG. 9 shows the baffle unit after being inserted in the staggered tube bank of a heat exchanger.

DESCRIPTION OF INVENTION

Figure 1:
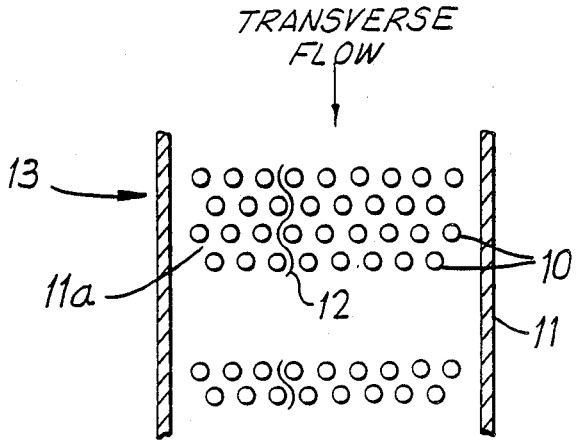
FIG. 1 shows schematically a corrugated acoustic baffle unit inserted into a staggered tube bank of a tubular heat exchanger in accordance with the invention.

As seen in FIG. 1, a bank of parallel staggered tubes 10 are provided within a pressurizable enclosure or shell 11 of a heat exchanger 13, such that a first fluid can flow within the tubes 10 and a second fluid can flow generally transversely across the tubes at a velocity sufficient to produce acoustic vibrations within the enclosure. The enclosure 11 can be made either generally rectangular or cylindrical-shaped depending upon the configuration desired for the heat exchanger 13. A corrugated-shape acoustic baffle unit 12 is shown installed between adjacent tubes 10.

Figure 2:
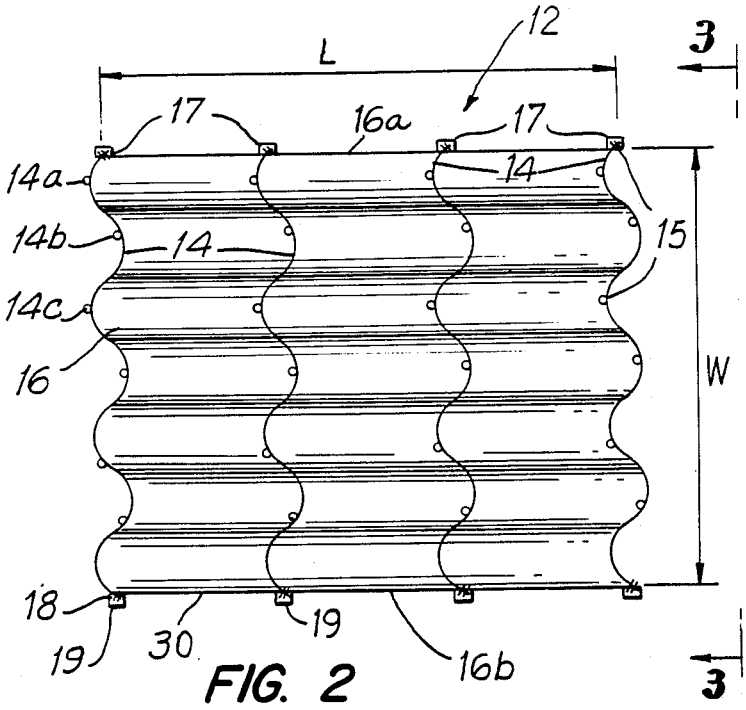
FIG. 2 shows a sinewave-shaped flexible acoustic baffle unit made of a flexible woven material attached to rotatable helical-shaped spacer members.
Figure 3:
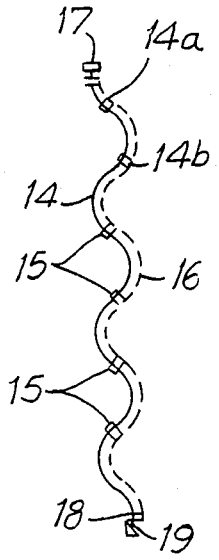
FIG. 3 shows an end view taken at lines 3—3 of FIG. 2.

As shown in greater detail in FIGS. 2 and 3, the flexible acoustic baffle unit 12 is composed of two principal components, including a plurality of elongated helical-shaped spacer rod members 14 each rotatably attached to a flexible barrier member 16. The spacer members 14 are each rotatably attached at points 14*a*, 14*b*, 14*c*, etc. to the flexible barrier members 16, so as to form the acoustic baffle unit 12. The helical-shaped spacer members 14 serve the dual function of maintaining the sinewave-shaped baffle geometry and permitting insertion of the flexible acoustic baffle unit 12 transversely into a tube bundle between adjacent staggered rows of tubes 10 during manufacture of heat exchanger 13. The acoustic barrier member 16 provides the body of the baffle unit 12, and serves as an acoustic wall for dividing the second fluid flow channel 11*a* into separate chambers having different acoustic properties.

In one useful embodiment of the invention, the flexible barrier member 16 is made of a woven material such as cloth or fabric including a metal wire mesh, as shown in FIGS. 2 and 3. The flexible barrier member 16 has suitable multiple attachment means 15 such as loops or rings provided at each end and also at intermediate positions along the width dimension W of the barrier member 16 for its attachment to each of the rotatable spacer members 14. Each rotatable spacer member 14 has its forward edge rotatably attached at 17 to the leading end 16*a* of the barrier member 16, and its rear end rotatably attached at 18 to the trailing edge 16*b* of the barrier member 16. Also, a rotation means 19 such as a nut is provided attached to the rear end of each helical-shaped spacer member 14. By this construction, it will be understood that by substantially simultaneous rotation of all the spacer members 14 by the rotation means 19, the flexible barrier unit 12 will be drawn incrementally into the space between adjacent rows of staggered tubes 10.

As shown in FIGS. 2 and 3, at least three helical-shaped spacer members 14 are preferably provided substantially equally spaced along the length L of the baffle unit 12. Each spacer member 14 spans the entire height or width W of the acoustic baffle unit 12, and the spacer members 14 are each rotatably attached to the baffle barrier 16 by the multiple loops 15 which encircle the rotatable helical-shaped spacer members 14. Because the ends of the spacer members 14 are each firmly rotatably attached at 17 and 18 to the leading and trailing edges, respectively, of the acoustic baffle member 12, so as to permit rotation of the spacer members at these connection points, the baffle unit can be conveniently inserted between adjacent tubes 10 in a tube bundle.

The relative dimensions of the helical-shaped spacer members 14 and the loops 15 are determined by the need to allow ease of rotation of the spacer members and also provide firm lateral support and control of the flexible barrier member 16. Suitable relative dimensions between the spacer members 14 and the loops 15 should provide diametrical clearance of 0.060–0.125 inches. The preferred construction for the attachments of the barrier 16 to the spacer members 14 in a fabric-type baffle unit are metal rings 15 attached to the fabric at suitable spaced intervals. Alternatively, a continuous flexible tube-like containment member for the spacer members 14 can be either made an integral part of the barrier fabric or attached to the barrier fabric by suitable fasteners.

Suitable materials for the flexible baffle member 12 will be determined by the fluid temperatures encountered as well as cost considerations. Steel spacer members and barrier members made of steel mesh are preferred primarily because of stiffness provided in the high flow and pulsation environment, and barriers made of a ceramic fiber material are desired where low weight is an important consideration.

Figure 6:
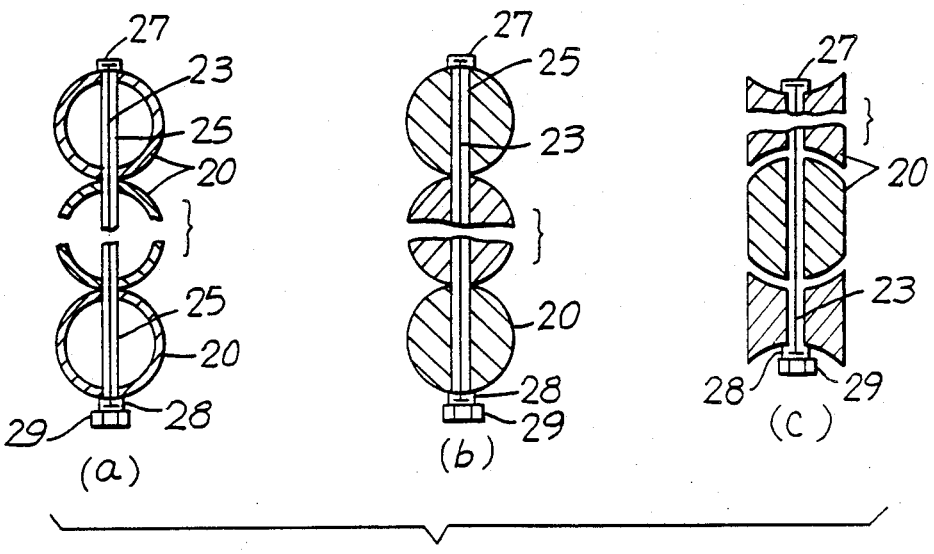
FIG. 6 shows some details of the adjacent bars or tubes which form the barrier member of the acoustic baffle unit of FIGS. 4 and 5.
Figure 4:
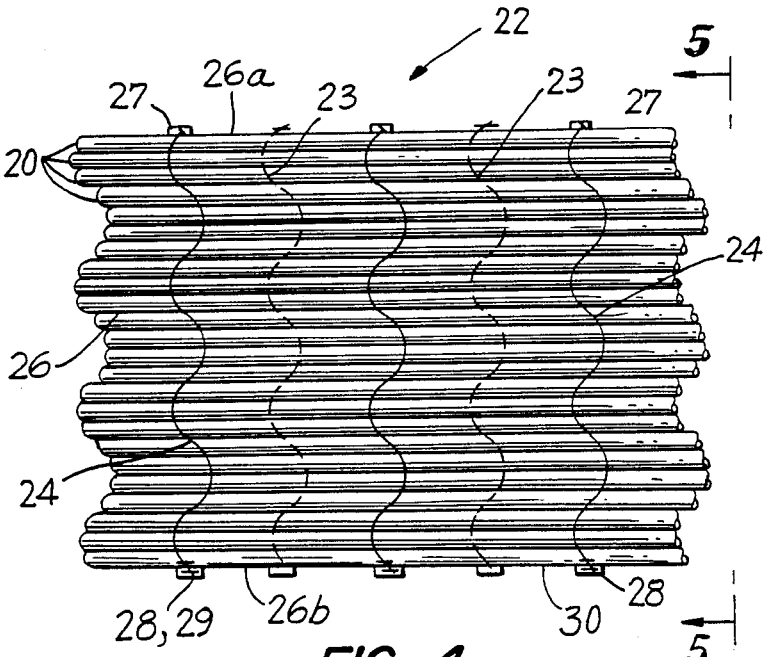
FIG. 4 shows an alternative embodiment of the invention in which the acoustic baffle unit is made of a plurality of adjacent parallel bars or tubes attached to rotatable helical-shaped spacer rod members.
Figure 5:
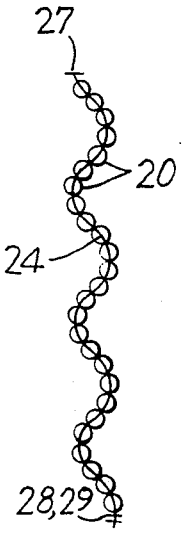
FIG. 5 shows a partial end view taken at lines 5—5 of FIG. 4.

In an alternative embodiment of this invention as shown in FIGS. 4–5, the baffle unit 22 is formed of a plurality of adjacent narrow parallel metal strips, bars or tubes 20 which are flexibly attached together, and are also attached to at least two rotatable helical-shaped spacer members 24. Cross-sectional shapes of suitable bars, strips or tubes which can be adapted for use as the barrier member 26 of the FIG. 4–5 embodiment as shown by FIG. 6. For this alternative embodiment, the helical-shaped spacer members 24 are each inserted through transverse holes 25 provided in each of the bars or tubes 20 near their opposite ends. Also, transverse holes 25 can be provided at an intermediate position or positions as needed along the length of the barrier bars or tubes 20 for receiving an additional spacer member 24. The diameter or major width dimension of the barrier bars or tubes 20 exceeds that of the spacer members 24. The spacer member diameter will usually be 0.20–0.50 inch, and the barrier bars or tubes will have a diameter or width of 0.30–0.75 inch.

The adjacent parallel members 20 are also each attached together by a flexible connection member 23, such as a connecting cable strung through transverse holes 25, as generally shown by FIG. 6, so that a tensile force can be transmitted transversely across the barrier member 26 during its installation in a tube bank. Alternatively, the adjacent rods or tubes 20 can be connected together by multiple hinged joints 23*a* provided between the adjacent bars or tubes 20, as shown by FIG. 7. The construction of the barrier member 26 must be sufficiently flexible to offer very little resistance for it being shaped into the sinewave geometry needed during insertion of the baffle unit 22 between adjacent tubes 10 of a heat exchanger using the helical-shaped rotatable spacer members 24.

The spacing between adjacent helical-shaped spacer member rods 14 is determined by the type of baffle unit construction used. A baffle unit 12 having a barrier 16 made of flexible fabric per FIGS. 2 and 3 requires relatively closely spaced spacer members located 9–12 inches apart, in order to maintain the flexible baffle unit 12 aligned and sufficiently stiff along the tubes of the tube bundle. However, a baffle unit 22 made of multiple adjacent bars or tubes 20 per FIGS. 4–5 can tolerate a larger spacing between the spacer members 24, because the bars or tubes 20 are relatively stiff as compared to the fabric barrier 16, and the spacing of the spacer rods 24 will be determined by the need to limit deflections of the bars or tubes 20 of the barrier member 26. The spacing between the helical spacer rods 24 of a typical baffle unit construction can be in the range of 36 to 72 inches.

The entire baffle unit 22 including the connected rods or tubes 20 is constructed so as to withstand a tensile force applied at its leading edge 26*a* by the helical-shaped spacer members 24 during insertion of the baffle unit into a tube bank. The helical-shaped spacer members each have their forward end rotatably attached at 27 to the leading edge 26*a* of the baffle unit in such a way that the spacers can exert a forward force upon the leading edge in the direction of the baffle insertion, per FIG. 8. Similarly, the spacer members 24 rear end is rotatably attached at 28 to the trailing edge 26*b* of barrier 26. Also, a rotation means 29 such as a nut is attached to the rear end of each helical-shaped spacer member 24 to provide for rotation of the spacer members by a suitable tool (not shown) as required for installation of the flexible baffle unit 22 in a tube bank.

The preferred construction material for the spacer members and the barrier bars or tubes 20 is steel. Carbon steel is used for spacers and baffle units which are exposed to cold air or gas temperatures up to about 800° F., and alloy steel including stainless steels are used for higher gas temperature environments up to 1200°–1800° F.

This invention also includes within its scope a tubular type heat exchanger 13 containing multiple rows of parallel tubes 10, and which has the corrugated acoustic baffle unit 12 installed therein as generally shown in a schematic cross-sectional view by FIG. 1. A description of such a tube type heat exchanger is provided by U.S. Pat. No. 4,204,570, which is incorporated herein by reference to the extent necessary.

Figure 10:
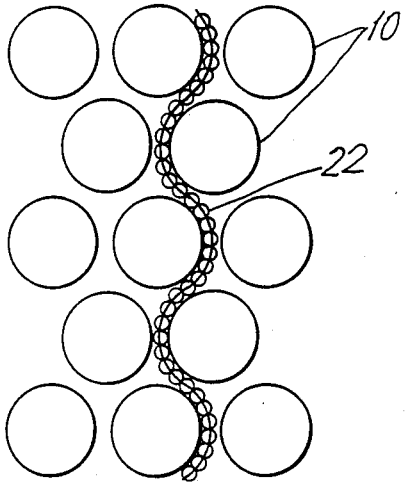
FIGS. 10, 11, and 12 show various useful configurations of acoustic baffle units after being inserted into a tube bank of a heat exchanger.
Figure 11:
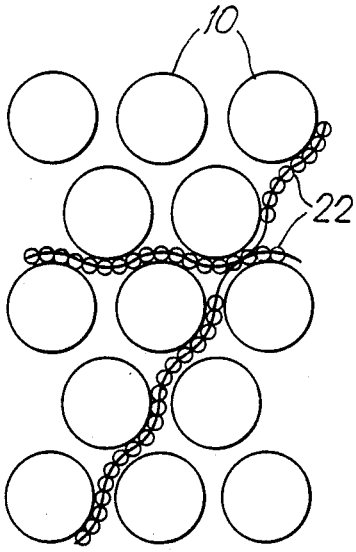
Figure 12:
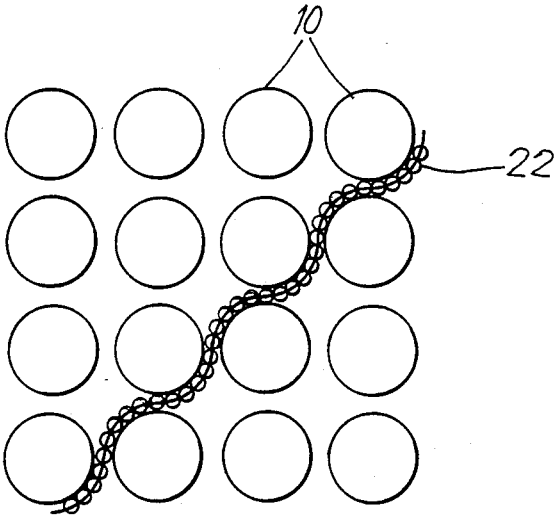

The method or procedure for insertion of the flexible acoustic baffle unit 12 into a tube bundle 10 is generally shown by FIGS. 8 and 9. The geometry of the helical spacer members 14 and the geometry of the sinewave-shaped barrier member 16 must conform to the geometry of the tube bundle and the direction of the insertion of the baffle unit between the adjacent tubes 10. The overall thickness of the acoustic baffle unit 12 must also conform to the available gap or space between adjacent tubes 10, both for ease of insertion and firmness of support provided by the tubes. Depending upon the orientation of the tube bundle cross-section relative to the fluid flow direction, the baffle unit insertion can be done in either the direction of a triangle apex (no see-through direction) as shown by FIG. 10, or in the direction of the triangle base (see-through direction) per FIG. 11, or in a diagonal direction for an in-line tube bank as shown by FIG. 12.

The normal method or procedure for installation insertion of the corrugated acoustic baffle unit 12 into the tube bundle is described below:

(a) Inspect the baffle unit 12, 22 to determine that it is truly sinewave-shaped along its entire length, i.e., the helical-shaped spacer members 14,24 holding the shape are oriented substantially parallel to each other, and the "peaks" and "valleys" of all the spacer members are in the same relative positions.

(b) Determine that the barrier member 16, 26 can take a "tensile" load in the direction of its height. This is achieved by the integrity of the fabric barrier material. For a barrier member made of adjacent multiple bars or tubes, the tensile load-carrying ability is provided by the cable-type ties 23 extending between the bars being capable of withstanding tensile loading.

(c) Determine that the leading edge of the baffle barrier member is firmly attached to the leading ends of each helical-shaped spacer member, with sufficient allowance for rotation of the spacer relative to the barrier. Similar end ties are also necessary at the trailing edge of the baffle unit.

(d) Determine that each helical spacer member 14, 24 can be rotated freely relative to the acoustic baffle barrier 16, 26.

The features listed above are normal characteristics of a properly designed and manufactured acoustic baffle unit according to the invention.

Insertion of the baffle unit into a heat exchanger tube bank includes the following steps:

(a) Select location for baffle unit insertion between tubes of the heat exchanger.

(f) Hold the baffle unit 12, 22 so that along its entire length the baffle unit faces the particular tube gap within which it is to be inserted.

(g) Commence inserting the baffle unit by rotating all helical-shaped spacer members 14, 24 substantially simultaneously. For spacer members having a righthanded helix, turn the spacers in a clockwise direction.

(h) Continue turning the helical spacer members until the entire baffle unit 12, 22 is inserted into the heat exchanger tube bundle to its full height or width.

(i) Connect the trailing ends of all helical-shaped spacer members to each other by a bar 30 rigidly attached such as by welding to each helical spacer member 14, 24. This connection will prevent the acoustic baffle unit 12, 22 from moving further relative to the tube bundle. Also similarly connect together the leading ends of the helical-shaped spacer members.

(j) Provide stops at each end of the acoustic baffle unit in tube axial direction, so as to prevent the entire baffle from sliding in a tube axial or longitudinal direction.

This invention will be better understood by reference to the following examples, which should not be construed as limiting the scope of the invention.

EXAMPLE 1

A flexible acoustic baffle unit is constructed which consists of four helical-shaped steel spacer rods which are rotatably attached to a flexible ceramic fabric barrier member at several places along the length of the rods. The helical-shaped spacer rods are inserted through a plurality of loops which are attached onto the flexible fabric at spaced intervals along the width of the barrier member. Important structural details of the baffle unit are provided below:

| | |
|---|---|
| Spacer rod length, in. | 42 |
| Spacer rod diameter, in. | 0.220 |
| Helical pitch of spacer rod, in. | 0.866 |
| Baffle width, in. | 48 |
| Number of attachment loops per spacer rod | 8 |

This flexible acoustic baffle unit containing fabric barrier can be inserted between adjacent tubes of a heat exchanger having 0.750 in. diameter tubes on a staggered pattern with a pitch spacing of 1.0 inch and a triangular (staggered) tube pattern.

EXAMPLE 2

An alternative flexible baffle unit is constructed which consists of two helical-shaped metal spacer rods which are each rotatably attached to a series of adjacent parallel metal tubes which form a barrier member. The tubes each contain two transverse holes in alignment with the metal helical-shaped spacer rods, which are inserted through each of the transverse holes in each tube. The tubes are also tied together by two steel cables, which each extend transversely through holes in the tubes so that the entire baffle unit can take a "tensile" force in the direction of its insertion into a tube bank. Important structural details of this baffle unit are as follows:

| | |
|---|---|
| Spacer rod length, in. | 80 |

-continued

| | |
|---|---|
| Spacer rod diameter, in. | 0.375 |
| Helical pitch of spacer rod, in. | 10.4 |
| Baffle tube diameter, in. | 0.625 |
| Baffle tube length, in. | 70.5 |
| Diameter of holes in baffle tubes, in. | 0.437 |
| Diameter of steel connecting cables, in. | 0.156 |

Any desired number of this baffle unit containing multiple parallel tubes can be inserted between adjacent parallel tubes of a heat exchanger in which the tubes are 5 in. diameter with a pitch of 6 inches in a staggered pattern.

Although this invention has been described broadly and in terms of specific embodiments, it will be understood that modifications and variations can be made within the scope of the invention, which is defined by the following claims.

I claim:

1. An acoustic baffle unit adapted for insertion between adjacent tubes of a tubular type heat exchanger, comprising:

a flexible barrier member rotatably attached to each of said spacer members, said flexible barrier member including means for rotatable attachment of forward and rear ends of said spacer members to the leading and trailing ends of said flexible barrier member; and means for rotating each said spacer members provided at the spacer member rear end, whereby the spacer members and the flexible barrier member can be inserted between adjacent tubes of a heat exchanger by simultaneously rotating the spacer members.

2. The acoustic baffle unit of claim 1, wherein said spacer members are rotatably attached to said flexible barrier member by being inserted through a plurality of loops attached to the flexible barrier member at spaced intervals.

3. The acoustic baffle unit of claim 1, wherein at least one intermediate spacer member is provided between said two rotatable spacer members.

4. The acoustic baffle unit of claim 1, wherein said flexible barrier member is formed of a flexible woven material attached to said spacer members at spaced intervals.

5. The acoustic baffle unit of claim 1, wherein said flexible barrier member is formed of a plurality of adjacent elongated parallel tube members attached together by at least two connecting members.

6. The acoustic baffle unit of claim 5, wherein said adjacent elongated parallel tube members are attached together by at least two connecting cable means extending laterally through the parallel tube members.

7. The acoustic baffle unit of claim 5, wherein said adjacent elongated parallel tube members are attached together by multiple hinged Joints.

8. The acoustic baffle unit of claim 1, wherein the baffle unit is inserted between two adjacent rows of tubes in a heat exchanger, so as to direct a fluid flowing transversely past the tubes and thereby prevent flow induced acoustic vibrations in the heat exchanger.

9. An acoustic baffle unit adapted for insertion between adjacent tubes of a tubular type heat exchanger, the baffle unit comprising:

(a) three elongated helical-shaped rotatable spacer members;

(b) a flexible barrier member attached to each said rotatable spacer member by a plurality of loops each attached to the barrier member at spaced intervals; and (c) means for rotatably attaching the forward and rear ends of said spacer members to the leading and trailing edges of said barrier member, and means attached to the spacer member rear ends for rotating said spacer members relative to the barrier members, whereby the spacer members and the barrier member can be inserted between adjacent staggered tubes of a heat exchanger by simultaneously rotating the spacer members.

10. A tubular type heat exchanger assembly, comprising:

a plurality of parallel extending tubes provided within a pressurizable enclosure;

a flexible baffle unit including at least two elongated helical-shaped rotatable spacer members and a corrugated-shaped flexible barrier member to which said spacer members are rotatably attached, said flexible baffle unit extending between adjacent rows of said parallel tubes so as to direct a fluid flowing transversely past the tubes and prevent flow-induced acoustic vibrations in the heat exchanger.

11. The heat exchanger according to claim 10, wherein at least one secondary helical spacer member is provided intermediate said rotatable spacer members to additionally support said flexible barrier member.

12. The heat exchanger according to claim 10, wherein said flexible barrier member is formed of a plurality of parallel tubes flexibly attached together.

13. A tubular type heat exchanger unit, comprising:

(a) a plurality of parallel tubes provided in adjacent staggered rows within a pressurizable shell;

(b) at least two helical-shaped rotatable spacer members inserted between adjacent staggered rows of tubes; and (c) a flexible barrier member attached at spaced intervals to said rotatable spacer members to form a corrugated-shaped baffle unit to direct a fluid flowing transversely past said tubes and thereby prevent flow-induced acoustic vibrations within the heat exchanger.

14. A method for inserting a flexible corrugated acoustic baffle unit between adjacent rows of tubes of a tube bundle, comprising the steps of:

(a) placing the leading edge of a corrugated flexible baffle unit between two adjacent rows of tubes, said baffle unit including at least two helical-shaped spacer members rotatably attached to a flexible barrier member;

(b) simultaneously turning said helical-shaped spacer members connected to said barrier member, so that the forward end of the baffle unit enters the space between the two adjacent rows of tubes; and (c) continue turning the helical-shaped spacer members until the baffle unit is entirely inserted into the tube bundle.

15. The baffle inserting method of claim 14, including after step (c) connecting together at least the trailing ends of the helical-shaped spacer members to stabilize the baffle unit in place in the tube bundle.

* * * * *